US005692349A

United States Patent [19]

Guillemet

[11] Patent Number: 5,692,349

[45] Date of Patent: Dec. 2, 1997

[54] MOLDED WINDOW FRAME FREE OF FASTENERS

[75] Inventor: Guy Guillemet, Terrebonne, Canada

[73] Assignee: Concept Guillemet Inc., Terrebonne, Canada

[21] Appl. No.: 568,662

[22] Filed: Dec. 7, 1995

[51] Int. Cl.[6] ..... E06B 3/30

[52] U.S. Cl. ..... 52/204.53; 52/204.54; 52/775

[58] Field of Search ..... 52/208, 204.53, 52/204.54, 204.55, 204.56, 204.62, 210, 211, 214, 476, 775

[56] References Cited

U.S. PATENT DOCUMENTS

| | | | |
|---|---|---|---|
| 3,203,053 | 8/1965 | Lane et al. | 52/204.54 |
| 3,691,713 | 9/1972 | Dulaney | 52/775 X |
| 4,040,219 | 8/1977 | Budich | 52/775 X |
| 4,648,237 | 3/1987 | Laroche | 52/775 |
| 5,379,518 | 1/1995 | Hopper | 52/204.54 X |

FOREIGN PATENT DOCUMENTS

| | | | |
|---|---|---|---|
| 1052661 | 3/1959 | Germany | 52/775 |
| 1509401 | 11/1969 | Germany | 52/775 |
| 640747 | 12/1959 | Italy | 52/476 |
| 396383 | 1/1966 | Switzerland | 52/775 |
| 2030627 | 4/1980 | United Kingdom | 52/476 |

*Primary Examiner*—Creighton Smith

[57] ABSTRACT

A frame made of moldable material is described for retaining a closure member, such as a window, in a door or wall opening. The frame is formed by interconnecting a peripheral main frame member, an outer peripheral casing connecting molding and inner peripheral sash connecting molding. The main frame member has an outer sash section, a side jamb section and an inner casing section. The outer casing connecting molding is adapted to be snappingly secured to the main frame member to clampingly retain the main frame member to a frame forming the opening. The inner sash connecting molding is adapted to be snappingly secured to the main frame member and has a bridge wall section to abut against a peripheral section of the closure member to retain it captive between the outer sash section and the inner sash connecting molding.

18 Claims, 4 Drawing Sheets

MOLDED WINDOW FRAME FREE OF FASTENERS

TECHNICAL FIELD

The present invention relates to a window frame made of moldable material, and preferably plastics material such as rigid PVC, and formed of a main frame member and opposed connecting moldings which are interconnected together by snap-fit retention without the use of metal fasteners.

BACKGROUND ART

It is a well known problem in the art that window frames are problematic thermal conduction and particularly air infiltration due to the fact that the frame bows between its fasteners. Most window frames use metal fasteners in its construction or other metal parts, and these act as thermal conductors across the frame. It is difficult to provide good sealing properties in window frames, and often water as well as air infiltrate through the frame.

SUMMARY OF INVENTION

It is a feature of the present to provide a window frame made of moldable material, such as plastic material, and which substantially overcome the above disadvantages of the prior art.

Another feature of the present invention is to provide a window frame made of injection molded or extruded plastics material which comprises few parts which are interconnected together by snap-fit engagement without the use of any fasteners.

Another feature of the present invention is to provide a window frame made of few plastic parts, thus facilitating the assembly and installation of the frame and wherein no special tools are required to install the frame.

According to the above features, from a broad aspect, the present invention provides a peripheral frame made of moldable material for retaining a closure member in an opening. The frame is formed by interconnecting a main frame member and an outer casing connecting frame molding and an inner sash connecting frame molding. The main frame member has an outer sash section, a side jamb section and an inner casing section. The outer casing connecting frame molding is adapted to be snappingly secured to the main frame member to clampingly retain the main frame member to a frame forming the opening. The inner sash frame molding is adapted to be snappingly secured to the main frame member to abut against a peripheral section of the closure member to retain it captive between the outer sash section and the inner sash frame molding. The frame is formed without the use of fasteners.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
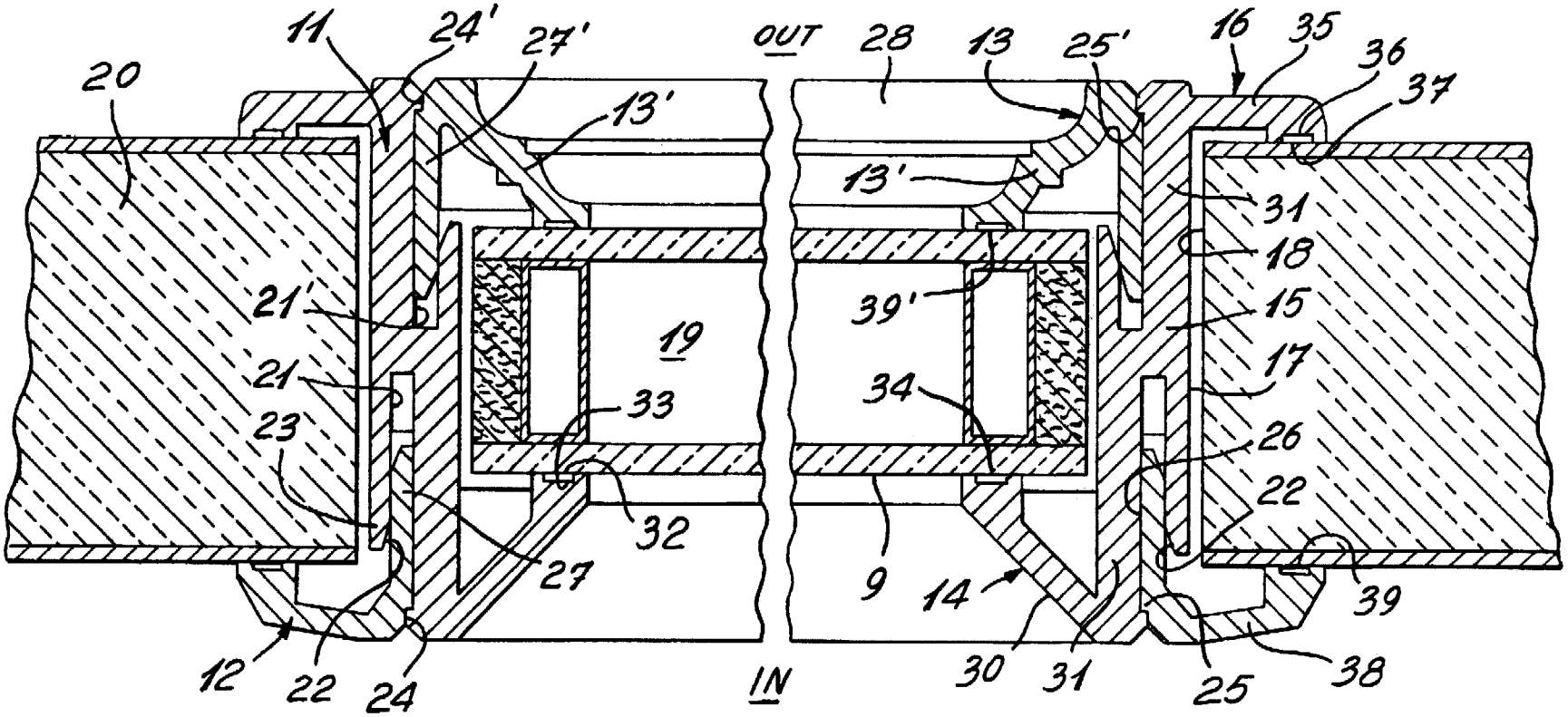
FIG. 1 is a section view illustrating the construction of the frame comprising the main frame member, the outer casing connecting molding and the inner sash molding and as herein shown retaining an insulated glass panel within a door frame opening.

Referring now to FIG. 1, there is shown generally at 10 the frame of the present invention. As herein shown the frame is made of moldable straight members formed of plastic materials, such as PVC. The frame is formed from a main frame member 11, an inner casing connecting frame molding 12 and an outer sash connecting frame molding 13. As herein shown the frame is of rectangular shape and therefore comprises a four-sided monocoque rectangular frame. The frames 11, 12 and 13 can be injected molded in one piece or be formed from interconnected frame members heat or ultrasonically welded at their connecting ends.

The main frame member 11 is of substantially Z-shape configuration in cross-section and defines an inner sash section 14, a side jamb section 15 and an outer casing section 16. The jamb section 15 is a straight section having a flat rear face 17 for abutment or space retention against the side face 18 of an opening 19 formed in a closure member herein a door panel 20. It is also pointed out that the opening may be a window opening formed in a wall or else an opening closed by a panel member instead of a glass panel. In other words, these frames could be used in the construction of a decorative door having decorative panels therein which panels may also be interchangeable. The moldings may have a decorative shape, such as the outer sash frame molding 13 to provide a decorative design.

As can be seen the main frame member is also provided with opposed longitudinal molding connecting slots 21 and 21', offset from one another, accessible along outer longitudinal edges thereof and spaced in front of the flat surface 17 of the side jamb section 15. These slots are open ended slots and have a beveled edge 22 at their outer longitudinal edges 23 to facilitate connection with the inner casing connecting frame molding 12 or outer sash connecting frame molding 13, as will be described later. The slots are also provided with a retention rib 24 having a right angle undercut for snap retention over a right-angle ledge 25 formed on a flat outer face 26 in a top end of a connecting web 27 of the inner casing connecting frame molding 12. The other slot 21' is also provided with a retention rib 24' for snapping retention engagement over a right-angle ledge 25' formed in the connecting web 27' of the outer sash connecting frame molding 13. The outer sash connecting frame molding 13 has a bridge wall section 13' for abutment against a peripheral section of the glass pane 9, as shown. As herein shown the outer sash connecting frame molding 13 has a decorative profile or outer face 28 to provide decorative appeal.

The inner sash section 14 is provided with an outwardly angulated depending wall 30 extending from a straight rear wall section 31 thereof. The depending wall 30 may have a decorative shape, such as shown at 28 with respect to the outer sash connecting molding 13, and terminates in a straight longitudinal abutment end edge 32. As herein shown the end edge 32 is provided with a slot 33 which may be provided with a seal 34, a blue strip, or a double-side adhesive tape therein. On the other hand it is conceivable that the opposed webs formed on each side of a slot 33 have sufficient flexibility to provide a seal rib being thin enough to provide flexion.

The outer casing section 16 formed at the other end of the Z-shape main frame member is defined by a right angle wall section 35 formed behind the straight rear wall section 31' and extends from one of the outer longitudinal edge of the side jamb section 15. The right angle wall section 35 terminates in a longitudinal inwardly facing abutment end edge 36 also provided with a slot 37, similar to the slot 33 and which provides another sealing means. The inner casing connecting frame molding 12 also defines a bridge wall section 38 also having a straight longitudinal abutment end edge 39 providing a seal means. An abutment end edge 39' is also provided at the free end of the bridge wall section 13' of the outer sash molding 13'. The outer visible section of the main frame member 11 may also have a decorative shape.

The main frame member and the glass panel 19 may be assembled with the glass panel secured to the inner sash section 14 by the application of glue beads within the cavity 40 or along the channels 33, such as shown at 34. The outer sash frame molding 13 can then be snapped fitted within the slots 21' whereby to clampingly secure the insulated window pane 9 between the outer sash section and the inner sash molding. This assembly can then be mounted in the opening 18 of the door panel 20 and interconnected therein by snap-fitting the connecting frame molding 12 in the slots 21.

Figure 2:
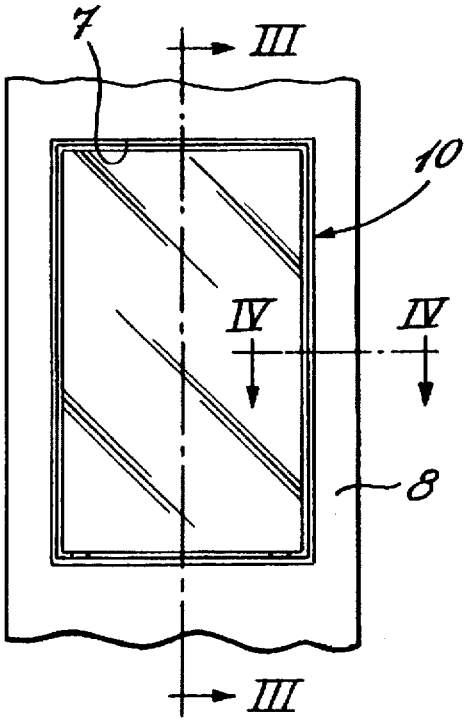
FIG. 2 is a plan view of a door having a window frame constructed in accordance with the present invention secured therein.
Figure 3:
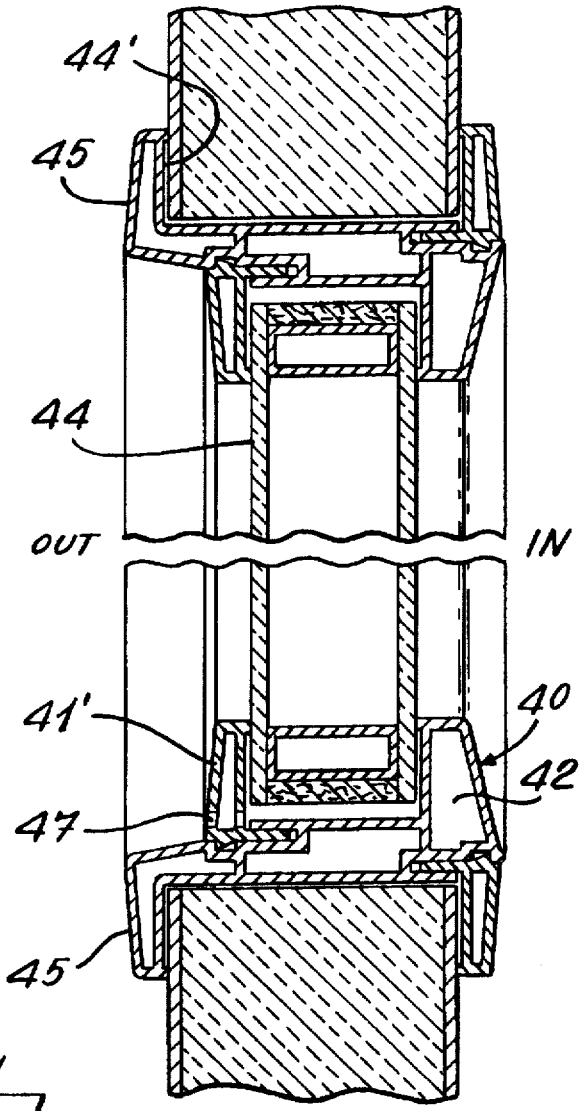
FIG. 3 is a section view along cross-section line III—III of FIG. 2.
Figure 4:
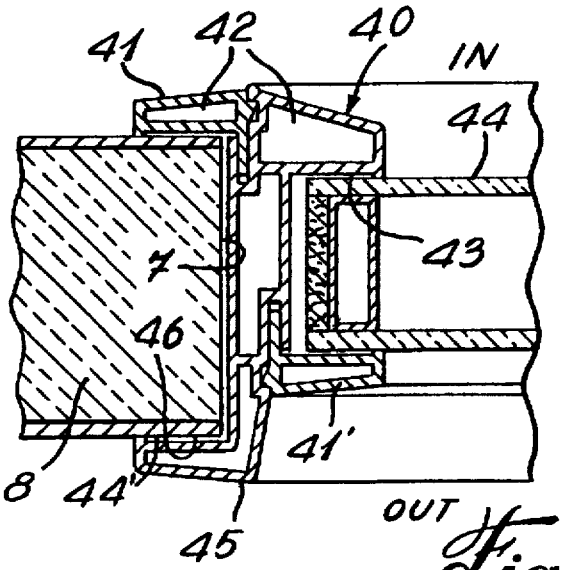
FIG. 4 is a section view along cross-section line IV—IV of FIG. 2.

FIG. 2 shows the window frame member 10 of the present invention as secured within an opening 9 of a door 8. FIGS. 3 and 4 illustrate the frame member, but herein formed of hollow extruded members which comprise a main frame member 40 and a common opposed connecting member 41. The structure is similar to that described in FIG. 1, although the members are made of extruded PVC and have hollow cavities 42 therein. As herein shown, a double adhesive tape 43 is interposed between the glazing 44 on the interior side of the glazing and a further double adhesive tape 44' is interposed between the outer casing section 45 and the side edge 46 of the door 8 adjacent the opening 7. As seen in FIG. 3, one of the corner members, herein member 41', is provided with holes 47 to permit evacuation of any water that may infiltrate from the outside, or to provide ventilation to evacuate any humidity that may build up along the bottom edge in the glazing cavity of the glazing 44.

Figure 5:
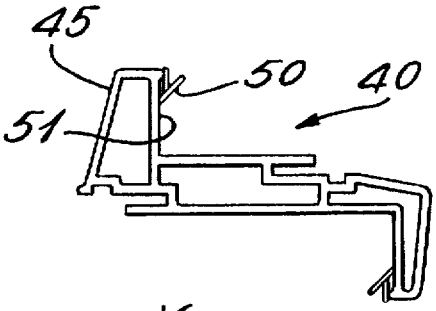
FIG. 5 is a cross-section view of the main frame member formed by extrusion molding having integral seal ribs formed therewith.
Figure 6:
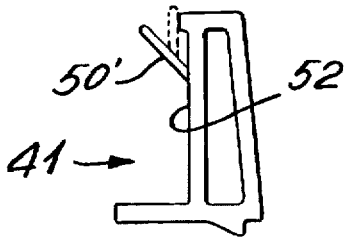
FIG. 6 is a section view of the connecting member, also formed by extrusion molding and having integral seal ribs.

As shown in FIGS. 5 and 6, the outer casing section 45 may be extruded/molded together with an integral seal rib 50 disposed on its inner abutment wall 51 to provide a seal. Similarly, such a seal rib 50' may also be integrally formed with the inner abutment wall 52 to also provide a seal.

Figure 7:
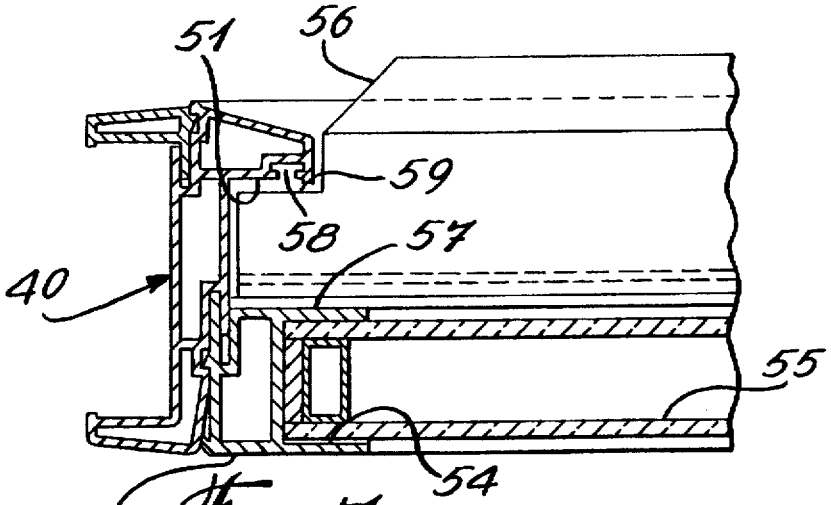
FIG. 7 is a fragmented section view showing a sliding window pane connecting a bracket secured to the main frame member for securing the fixed sash portion of the sliding window.

FIG. 7 is a section view showing the versatility of the main frame member 40, and as herein shown, the connecting member 53 is formed as a window pane connecting bracket having a channel 54 formed integral therewith for receiving an insulated double-glazed glass pane 55 therein. This bracket is used to secure a stationary pane within a window frame, and a further sliding pane 56 may be provided for sliding movement adjacent thereto in a channel formed by the side wall 57 of the connecting member 53 and the inner abutment wall 51 of the main frame member 40. A seal retaining cavity 58 may also be provided in the inner abutment wall to provide the seal in that area with the flange wall 59 of the sliding window pane 56.

Figure 8:
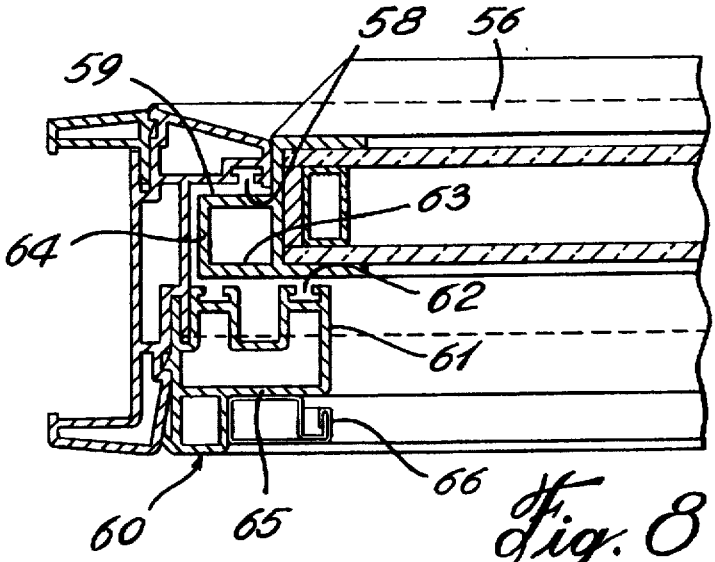
FIG. 8 is a fragmented section view showing a further frame bracket secured to the main frame member and forming a side post and a screen retaining cavity and showing the moving sash portion of the sliding window.

FIG. 8 illustrates a still further embodiment of the connecting member 60, herein provided with a side post 61 having a pair of seal retaining channels 62 formed on an inner face thereof for receiving seals (not shown) for sealing engagement with the flange portion 64 of the sliding window pane 56- The side post is also formed with a screen retaining cavity 65 for retaining a screen 66 therein.

Figure 9:
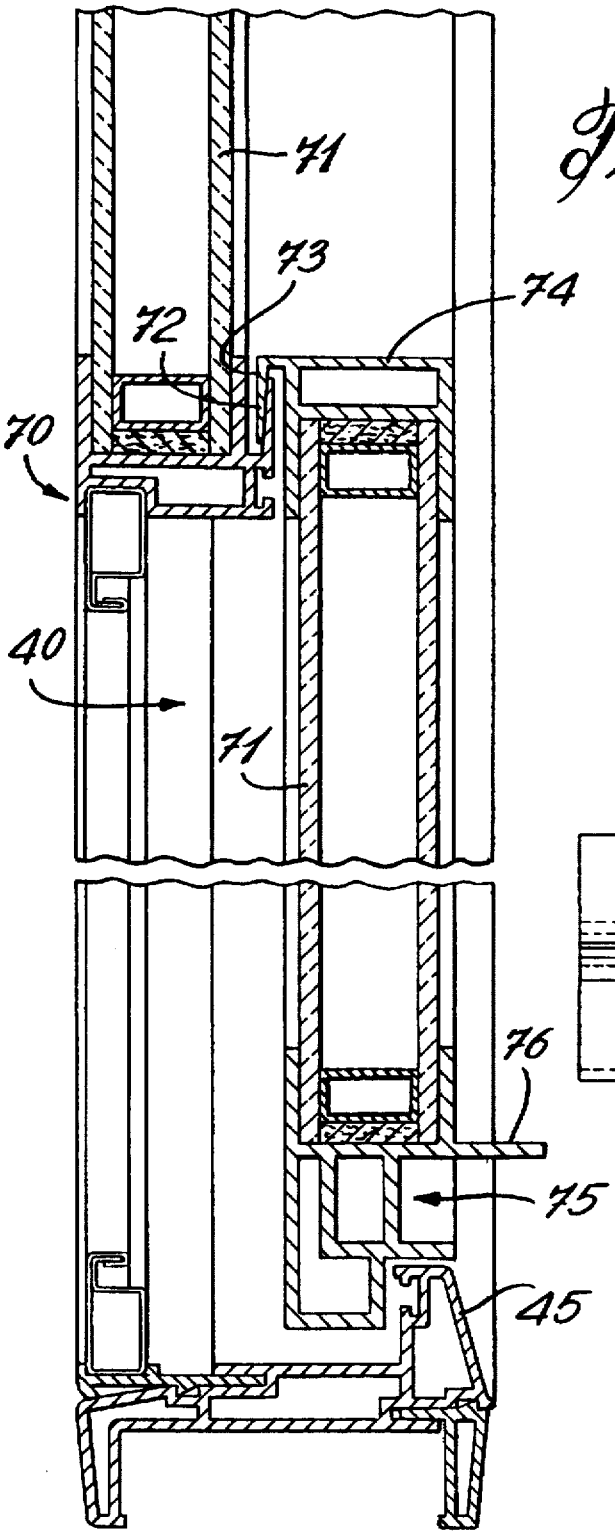
FIG. 9 is a fragmented vertical section view of the sliding window having a center post bracket for horizontal sliding panes wherein one of the connecting members also has a screen retention cavity.

FIG. 9 illustrates a still further embodiment wherein a center post bracket 70 is connected vertically between opposed horizontal main frame members 40 to provide for horizontal sliding panes 71. The center post is provided with a retention cavity 72 to receive a stop-rib 73 of a sliding pane vertical post 74 to arrest the horizontal sliding displacement thereof. As herein shown, the sliding pane 71 is also provided with a free end edge member 75 for abutment against the casing section 45 and providing a vertical flange 76 for grasping and displacing the sliding pane 71. The cavity 75' permits the insertion of a lock mechanism therein.

Figure 10:
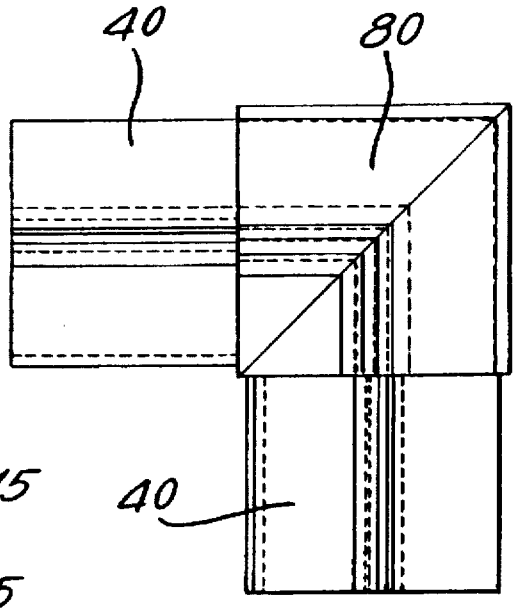
FIG. 10 is a plan view of a corner connector for interconnecting the ends of main frame members.

FIGS. 10 illustrates the construction of the corner bracket 80 used for interconnecting the free ends of opposed main frame members 40.

An advantage of this frame construction is that it is entirely assembled without the use of fasteners, such as metal screws which are thermal conductive. Also, because there is a straight interconnection across the frame by the main frame member 15 there is provided a complete seal from the outside to the inside of the frame preventing water from infiltrating therein. Still further the abutment end edges of the connecting molding, the inner sash section, the inner casing section and the outer sash connecting molding provide dual seals on each side of the frame and accordingly air cannot infiltrate therebetween. The hollow moldings may also have their inner cavities filled with an insulating foam material.

It is within the ambit of the present invention to cover any other obvious modifications thereof, provided these modifications fall within the scope of the appended claims.

I claim:

1. A peripheral frame made of moldable material adapted to removably retain a closure member in an opening defined in a wall or door panel structure, said frame being formed by interconnecting a main frame member and inner casing connecting frame molding and outer sash connecting frame molding; said main frame member having an inner sash section, a side jamb section and an outer casing section; said inner casing connecting frame molding being adapted to be snappingly secured to said main frame member to clampingly retain said main frame member about said opening, said outer sash connecting frame molding being adapted to be snappingly secured to said main frame member and having a bridge wall section adapted to abut against a peripheral section of a closure member to retain said closure member captive between said inner sash section of said main frame member and said outer sash connecting frame molding, said outer sash connecting frame molding permitting a closure member to be removed without disconnecting said main frame member from about said opening, said peripheral frame being formed without the use of fasteners.

2. A frame as claimed in claim 1 wherein said main frame member is of substantially Z-shape profile with said outer casing section and inner sash section formed integrally with said side jamb section and extending in opposed directions at opposed outer longitudinal edges thereof.

3. A frame as claimed in claim 2 wherein said main frame member is provided with a longitudinal molding connecting slot along opposed ones of said outer longitudinal edges thereof, said slot being disposed behind a rear straight wall section of said inner sash section and said outer casing section, first retention means in said rear straight wall section for snap mating connection with second retention means in said inner casing connecting frame molding and inner sash connecting frame molding, respectively.

4. A frame as claimed in claim 3 wherein said inner sash section has an outwardly angulated depending wall extending from said rear straight wall section thereof, said depending wall defining a straight longitudinal abutment end edge, and seal means defined in said abutment end edge.

5. A frame as claimed in claim 3 wherein said outer casing section is defined by a right-angle wall section formed behind said rear straight wall section and extending from one of said outer longitudinal edge of said side jamb section, said right-angle wall section terminating in a longitudinal inwardly facing abutment end edge, and seal means defined in said inwardly facing abutment end edge.

6. A frame as claimed in claim 5 wherein said right angle wall section of said outer casing section and said bridge wall section of Said inner casing connecting frame molding are molded with a flexible integral seal rib to constitute said seal means.

7. A frame as claimed in claim 5 wherein said seal means is a two-sided adhesive tape.

8. A frame as claimed in claim 3 wherein said first retention means is a rib having a right angle undercut for snap retention over a right-angle ledge formed on a flat outer face in a top end of a connecting web of said inner casing connecting frame molding and outer sash connecting frame molding, respectively.

9. A frame as claimed in claim 8 wherein said longitudinal molding connecting slot along opposed ones of said outer longitudinal edges are offset from one another and each has an opening facing in opposed directions.

10. A frame as claimed in claim 3 wherein said inner casing connecting frame molding and said outer sash connecting frame molding are each provided with straight longitudinal abutment end edges having seal means defined therein.

11. A frame as claimed in claim 1 wherein said main frame member and said inner casing connecting frame molding and said inner sash connecting frame molding are straight molded members formed from plastics material.

12. A frame as claimed in claim 1 wherein said frame is fused at corners thereof, said window being an insulated glass pane.

13. A frame as claimed in claim 1 wherein said frame is a window frame.

14. A frame as claimed in claim 13 wherein said main frame member, said inner casing connecting frame molding and said inner casing connecting frame molding are straight plastic extruded moldings interconnected together to form said frames.

15. A frame as claimed in claim 1 wherein said bridge wall section of said inner casing connecting frame molding is a window panel connecting member having a pane receiving channel extending at right angles to said side jamb section of said main frame member.

16. A frame as claimed in claim 1 wherein said bridge wall section of said inner casing connecting frame molding is a window frame side post section having inner seal means for abutment contact with a sliding side frame of a sliding pane.

17. A frame as claimed in claim 16 wherein said window frame side post section has a screen retention cavity for receiving a screen member in friction fit therein.

18. A frame as claimed in claim 1 wherein said main frame member and said inner casing connecting frame molding and outer sash connecting frame molding are rectangular plastic injected frames.

* * * * *